United States Patent [19]

Kenny et al.

[11] Patent Number: 4,877,560

[45] Date of Patent: Oct. 31, 1989

[54] CARBURETOR AND VALVE MECHANISM

[75] Inventors: Brian P. Kenny; Roger A. Bowles, both of Tralee, Ireland

[73] Assignee: Tillotson Ltd., Tralee, Ireland

[21] Appl. No.: 181,567

[22] Filed: Apr. 14, 1988

[30] Foreign Application Priority Data

Apr. 14, 1987 [IE] Ireland ..... 975/87
Apr. 14, 1987 [IE] Ireland ..... 976/87

[51] Int. Cl.[4] ..... F02M 1/16

[52] U.S. Cl. ..... 261/35; 261/39.5; 261/DIG. 68; 261/DIG. 8; 251/253

[58] Field of Search ..... 251/253; 261/DIG. 8, 261/39.5, 35, DIG. 68

[56] References Cited

U.S. PATENT DOCUMENTS

| | | | |
|---|---|---|---|
| 286,365 | 10/1883 | Zane | 251/253 |
| 382,654 | 5/1888 | Montgomery | 251/253 |
| 1,853,329 | 4/1932 | Austin | 251/253 |
| 1,858,590 | 5/1932 | Henion | 251/253 |
| 3,767,173 | 10/1973 | Ishii | 261/DIG. 8 |
| 4,373,479 | 2/1983 | Billingsley et al. | 261/DIG. 8 |
| 4,394,852 | 7/1983 | Tuckey et al. | 261/DIG. 8 |
| 4,498,434 | 2/1985 | Baltz et al. | 261/DIG. 8 |
| 4,684,484 | 4/1987 | Guntly | 261/DIG. 8 |
| 4,735,751 | 4/1988 | Guntly | 261/DIG. 8 |

FOREIGN PATENT DOCUMENTS

| | | | |
|---|---|---|---|
| 0253469 | 1/1988 | European Pat. Off. . | |
| 1600424 | 10/1981 | United Kingdom | 261/DIG. 39 |

*Primary Examiner*—Tim Miles
*Attorney, Agent, or Firm*—Harness, Dickey & Pierce

[57] ABSTRACT

A carburetor comprising a main body portion defining a carburetor mixing passage having an air intake side and an engine outlet side, a fuel pump, a throttle shutter mounted within the carburetor mixing passage between the air intake side and the engine outlet side. The carburetor has a metering chamber for supplying fuel from the fuel pump into the carburetor mixing passage via a main discharge port, the main discharge port opens into the carburetor mixing passage on the air intake side of the throttle shutter. A starting fuel supply passage extends from the pressure side of the fuel pump to the carburetor mixing passage. A means is provided for selectively opening and closing the starting fuel supply passage such that when the throttle is in a partially opened position and the starting fuel supply passage is open, the fuel pump causes fuel to be injected through the starting fuel supply passage into the carburetor mixing passage.

14 Claims, 2 Drawing Sheets

CARBURETOR AND VALVE MECHANISM

This present invention relates to a carburetor and valve mechanism. The invention has particular application with carburetors of the diaphragm type used in chainsaws.

It has been the practice on chainsaws to which such carburetors have been fitted, to fit a choke within the air filter housing or in the carburetor body which consists essentially of a shutter blade which is selectively positionable in front of the carburetor venturi.

This, however, has its disadvantages. In particular, since the choke is operated from the main fuel discharge port (main jet), if the latter is incorrectly adjusted great difficulty may be encountered starting the engine due to the incorrect air/fuel ratio.

In published European patent specification No. 253,469 the contents of which are incorporated herein by reference, there is described a carburetor having an improved choking mechanism. This choking mechanism comprises a starting fuel supply passage extending from the metering chamber to the throttle bore, the starting fuel supply passage opening into the throttle bore on the opposite side of the throttle shutter to the main discharge port, and means for selectively opening and closing the starting fuel supply passage. When the throttle shutter is in a partially opened position and the starting fuel supply passage is open, a lower pressure in the throttle bore on the engine outlet side of the throttle shutter than on the air intake side, causes fuel to be drawn from the metering chamber primarily through the starting fuel supply passage into the throttle bore on the engine outlet side of the throttle shutter.

Although this mechanism operates reasonably satisfactorily it has one disadvantage in that the throttle shutter angle is very critical and has to be set very accurately to achieve the required vacuum to draw sufficient fuel through the starting fuel supply passage.

According to one aspect of the present invention there is provided a carburetor comprising a main body portion defining a carburetor mixing passage having an air intake side and an engine outlet side, a fuel pump, a throttle shutter mounted within the carburetor mixing passage between the air intake side and the engine outlet side, a metering chamber for supplying fuel from the fuel pump into the carburetor mixing passage via a main discharge port and at least one idle discharge port, the main discharge port opening into the carburetor mixing passage on the air intake side of the throttle shutter, a starting fuel supply passage extending from the pressure side of the fuel pump to the throttle, means for selectively opening and closing the starting fuel supply passage, such that when the throttle shutter is in a partially opened position and the starting fuel supply passage is open, the fuel pump causes fuel to be injected through the starting fuel supply passage into the carburetor mixing passage.

Preferably the outlet port is in fluid communication with the air intake side of the carburetor mixing passage.

Preferably the starting fuel supply passage comprises a bore formed in the main body portion of the carburetor, extending from the fuel inlet supply channel to the carburetor mixing passage.

One advantage of the invention as compared to the prior art is that a direct choke system is used, i.e. it is substantially independent of the setting of the main jet adjustment. Consequently, the engine is easier to prime and choking will always work irrespective of the main jet setting.

A particular advantage of the invention is that the throttle shutter angle is not critical in choking operation because the fuel is injected under pressure from the pump, rather than solely under the influence of vacuum.

According to a second aspect of the present invention there is provided a valve mechanism for opening and closing a fluid passage in a carburetor comprising, a movable member for selectively opening and closing the fluid passage in the carburetor, means capable of biasing the member into a position to close the fluid passage, characterized in that there is provided a two-position cam means acting between the carburetor and the movable member, such that a first position of the cam means defines a closed condition of the fluid passage and a second position of the cam means defines an open condition of the fluid passage.

Embodiments of the invention will now be described by way of example, with reference to the accompanying drawings, in which.

Figure 1:
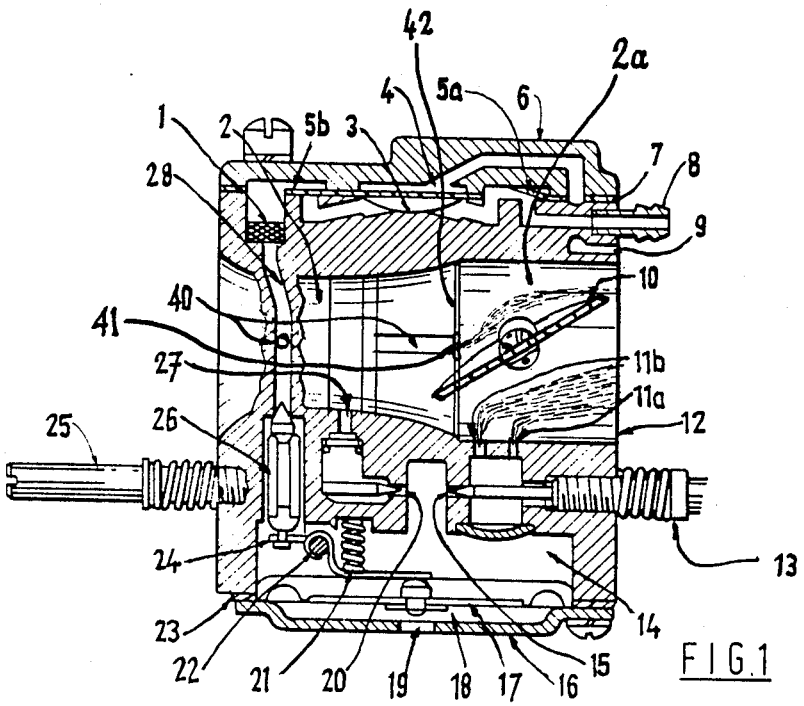
FIG. 1 is a cross-section of an embodiment of a carburetor according to the present invention in its choked condition.

Referring now to FIG. 1, there is shown a cross-sectional diagram of a carburetor according to the present invention, and the parts indicated by the reference numerals in FIG. 1 are identified in the following list:

1. Filtering screen.
2. Venturi.
3. Fuel chamber.
4. Pulse chamber.
5. Fuel pump diaphragm.
5*a*. Pump diaphragm inlet valve.
5*b*. Pump diaphragm outlet valve.
6. Fuel pump body.
7. Fuel pump gasket.
8. Fuel inlet.
9. Impulse channel.
10. Throttle shutter.
11*a*. Primary idle discharge port.
11*b*. Secondary idle discharge port.
12. Main carburetor body.
13. Idle fuel adjustment.
14. Metering chamber.
15. Idle fuel adjustment orifice.
16. Diaphragm cover.
17. Metering diaphragm.
18. Atmospheric chamber.
19. Atmospheric vent.
20. Main fuel adjustment orifice.
21. Inlet tension spring.
22. Fulcrum pin.
23. Diaphragm gasket.
24. Inlet control lever.
25. Main fuel adjustment.
26. Inlet needle.
27. Main nozzle discharge port.

28. Fuel inlet supply channel.

Since such carburetors are well known in the art, a full description of the operation thereof is not considered necessary and reference should be made to European patent specification No. 253,469 for a full description. The following description will therefore describe the main difference between the mechanism described in European patent specification No. 253,469 and the present invention.

Referring now to FIG. 1 there is shown an embodiment of a carburetor according to the present invention having a different choking mechanism. In FIG. 1, parts which serve a like function to parts described in European patent specification No. 253,469 have been given the same reference numerals. It will be noted that the choke feed hole 31 described in European patent specification No. 253,469 has been omitted together with its associated parts, the bore 34, and plunger 32. In the present invention, a starting fuel supply passage 40 extends from the fuel inlet supply channel 28 into the throttle bore 2a of a carburetor mixing passage. The starting fuel supply passage 40 is formed in a solid part of the carburetor body.

The starting fuel supply passage 40 has an opening 41 which is located in the air intake side of the throttle bore 2a and more particularly in the region of the notional intersection 42 of the venturi 2 and throttle bore 2a of a carburetor mixing passage. It has been found that the location of the opening 41 at the notional intersection of the venturi 2 and throttle bore 2a provides a particularly effective operation of the carburetor and of an engine on which it is used.

Suitable valve means are provided for selectively opening and closing the starting fuel supply passage 40. For example, a plunger mechanism described in European patent specification No. 253,469 may be used or more preferably an on/off valve mechanism as described below.

To choke the engine, the throttle shutter 10 is partially but not fully opened, and the starting fuel supply passage 40 is opened. This is the condition of the carburetor in FIG. 1.

As the engine is cranked, engine vacuum is transmitted to the metering chamber 14 through the idle discharge ports 11a and 11b creating a low pressure on the fuel side 14 of the diaphragm 17. Atmospheric pressure in the chamber 18 forces the diaphragm 17 upwards to the open the inlet needle 26. This permits fuel to enter the metering chamber 14 and from there to enter the venturi 12/throttle bore 2a, through the orifice 15 and idle discharge ports 11a and 11b for supply to the engine. In addition fuel is injected through the starting fuel supply passage 40 from the fuel inlet supply channel 28, under pressure from the fuel pump 5, into the throttle bore 2a. When the engine has reached its operating temperature, the carburetor is operated in normal fashion by opening up the throttle shutter 10 and simultaneously closing the starting fuel supply passage 40, whereby the main discharge port 27 comes into operation.

The basic difference between the present choking mechanism and that described in European patent specification No. 253,469 is that in the present mechanism fuel is injected under pressure directly from the pump 5 rather than being solely induced from the metering chamber under vacuum. This positive injection of fuel under pressure has been found to provide an increased reliability of operation of the carburetor. Of course, the vacuum induced in the carburetor when the engine is cranked also assists in the drawing of fuel into the carburetor via the starting fuel supply passage 40.

In addition, it will be appreciated that the setting of the throttle shutter 10 is not critical as it is in the mechanism of the abovementioned European patent specification. Further, if desired, the starting fuel supply passage 40 may extend into the throttle bore 2a on the engine outlet side of the throttle bore 2a (i.e. the right hand side as viewed in FIG. 1), so that the fuel has a smaller distance to travel before being inspired into the engine.

It is to be understood that the diameter of the orifice of the starting fuel supply passage 40 must be properly selected to ensure optimum engine starting and continued running with the choke on.

Figure 2:
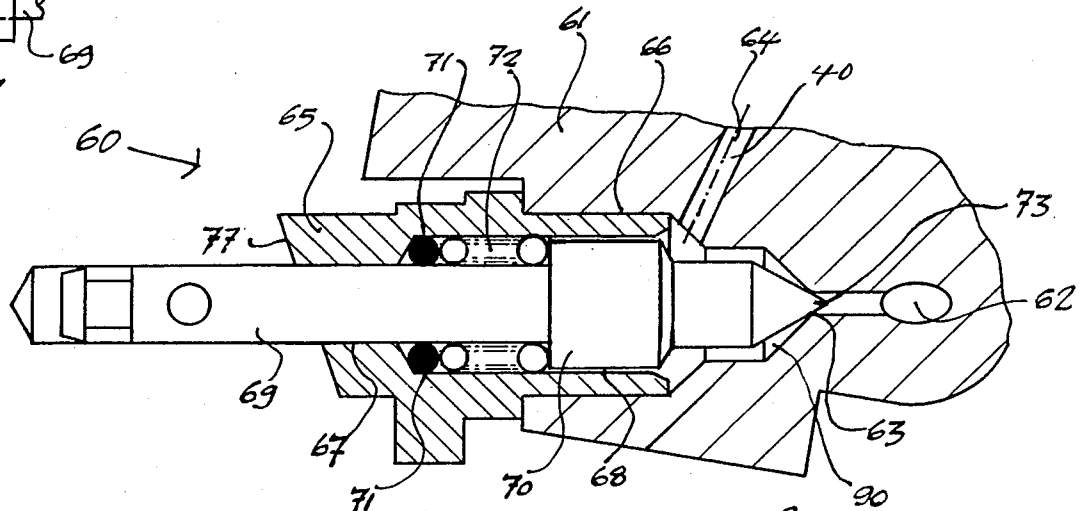
FIG. 2 is a cross-sectional view of a valve mechanism in a closed condition according to the invention but not showing the control lever.
Figure 3:
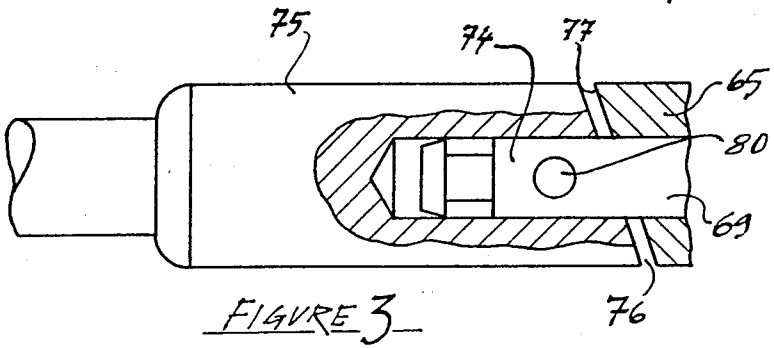
FIG. 3 is a diagrammatic view of the position of the control lever and bushing in the closed condition of the valve mechanism.
Figure 4:
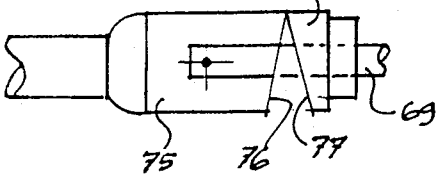
FIG. 4 is a diagrammatic view of the position of the control lever and bushing in an open condition of the valve mechanism.

Referring now to FIGS. 2 to 4 of the drawings, there is shown therein a valve mechanism generally indicted at 60 according to the invention. The valve mechanism 60 comprises a carburetor body portion 61 having an inlet port 62, a valve seat 63 and an outlet port 64. A plastic bushing 65 is a push fit into a recess 66 in the carburetor body portion 61. The bushing 65 has a recess 67 opening into a larger recess 68 and a needle or valve member 69 is axially slidable in the recesses 67, 68.

The needle or valve member 69 has integrally formed thereon a collar 70 which is a sliding fit in recess 68. An 'O' ring seal 71 is located in the recess 68 at the opposite end of the recess 68 from the collar 70 of the needle 69. A compression spring 72 acts between the 'O' ring 71 and the collar 70 to resiliently bias the tip 73 of the needle 69 against the valve seat 63. The tip 73 of the needle 69 is preferably of a hardened rubber material. The 'O' ring 71 is thus compressed by the coil spring 72 to provide an excellent fluid seal between the needle 69 and the bushing 65 particularly when the needle is move to the left in FIG. 2.

The free end 74 of the needle 69 is engaged with or fixed to control lever 75. The control lever 75 and the bushing 65 being held together by a pin 80, have cooperating slanted cam surfaces 76, 77 respectively. In an off or closed position of the valve mechanism 60, as shown in FIG. 2, the control lever 75 is in the position of FIG. 3 with the two cam surfaces 76, 77 just slightly spaced apart from each other.

To open the valve mechanism the control lever 75 is rotated through 180° to the position shown in FIG. 4 in which the needle 69 is moved axially away from the valve seat 63 to permit fluid flow from the inlet port 62 to the outlet port 64 via a channel 90. As the control lever 75 is rotated, the cam surfaces 76, 77 engage each other and the control lever 75 and needle 69 are moved to the left in FIG. 2 so that the tip 73 of the needle 69 moves away from the valve seat 63. As the needle 69 moves away form the valve seat 63 the coil spring 72 is compressed by the collar 70. The control lever 75 may be rotated manually or automatically. To close the valve mechanism again, the control lever 75 is again rotated to the position of the FIG. 3.

The valve mechanism will have particular application in a carburetor for selectively opening and closing a starting fuel supply passage or hole during operation of an engine as is used for example on a chainsaw. Typical carburetors in which the present invention, will have application are described above and also in the Applicants' European patent specification No. 253,469.

For example, in the carburetor of FIG. 1 described above, it will be apparent to those of ordinary skill in the art that the body portion 61 of the valve mechanism 60 corresponds to the main body portion 12 of the carburetor. Similarly, the inlet port 62 of the valve mechanism 60 corresponds with the fuel inlet supply channel 28 and the outlet port 64 corresponds with the opening 41. Thus, in operation, the valve mechanism 60 is mounted on the main body portion 12 of the carburetor and during choking operation of an engine, with the valve mechanism 60 open, fuel from the fuel inlet supply channel 28 enters inlet port 62 and is injected into the carburetor via the starting fuel supply passage 40 and the fuel outlet port 64. Thus, the valve mechanism 60 provides a simple mechanism which is readily operated, to control the flow of fuel through the starting fuel supply passage 40.

We claim:

1. A carburetor comprising a main body portion defining a carburetor mixing passage comprising a venturi and a throttle bore and having an air intake side and an engine outlet side; a fuel pump; a fuel inlet supply channel for conveying fuel from the fuel pump to the carburetor mixing passage; a throttle shutter mounted within the carburetor mixing passage between the air intake side and the engine outlet side; a metering chamber for supplying fuel from the fuel pump into the carburetor mixing passage via a main discharge port and at least one idle discharge port, the main discharge port opening into the carburetor mixing passage on the air intake side of the throttle shutter; a starting fuel supply passage having an inlet port and an outlet port wherein said inlet port is in direct fluid communication with the supply channel and said outlet port is in direct fluid communication with the carburetor mixing passage and said inlet port is in direct fluid communication with said outlet port; manual valve means for selectively opening and closing the starting fuel supply passage such that when the throttle shutter is in a partially open position and the starting fuel supply passage is open, the fuel pump causes fuel to be injected through the starting fuel supply passage into the carburetor mixing passage, said manual valve means mounted directly in said carburetor main body wherein the means for selectively opening and closing the starting fuel supply passage comprises a movable member, means capable of biassing the member into a position to close the starting fuel supply passage, a two-position rotatable cam means acting between the carburetor and the movable member, said cam means comprises a first cam surface securable to the carburetor body and a second cam surface engaged with the movable member, such that a first position of the cam means defines a closed condition of the starting fuel supply passage and a second position of the cam means defines an open condition of the starting fuel supply passage.

2. A carburetor as claimed in claim 1 wherein said outlet port is in fluid communication with the air intake side of the carburetor mixing passage.

3. A carburetor as claimed in claim 1 wherein the starting fuel supply passage comprises a bore formed in the main body portion of the carburetor, extending from the fuel inlet supply channel to the carburetor mixing passage.

4. A carburetor as claimed in claim 1 wherein the starting fuel supply passage defines an opening which is located in the region of the notional intersection of the venturi and throttle bore.

5. A carburetor as claimed in claim 1 wherein the movable member is axially slidable during movement of the cam means between its two positions.

6. A carburetor as claimed in claim 1 wherein one of the cam surfaces is rotatable relative to the other cam surface.

7. A carburetor as claimed in claim 1 wherein the biassing means comprises a coil spring.

8. A carburetor as claimed in claim 1 wherein said first cam surface is provided on a bushing securable in the carburetor body and said second cam surface is provided on a control level engaged with the moveable member.

9. A carburetor as claimed in claim 8 wherein the biassing means is located in a recess in the bushing and acts between a collar on the moveable member and a sealing member also located in the recess in the busing.

10. In combination, a carburetor and a valve mechanism which carburetor comprises a main body portion defining a carburetor comprises a main body portion defining a carburetor mixing passage comprising a venturi and a throttle bore having an air intake side and an engine outlet side; a fuel pump; a fuel inlet supply channel for conveying fuel from the fuel pump to the carburetor mixing passage; a throttle shutter mounted within the carburetor mixing passage between the air intake and the engine outlet side; a metering means via a main discharge port and at least one idle discharge port, the main discharge port opening into the carburetor mixing passage on the air intake side of the throttle shutter; a starting fuel supply passage having an inlet port and an outlet port wherein said inlet port is in direct fluid communication with the supply channel and said outlet port is in direct fluid communication with the carburetor mixing passage and said inlet port is in direct fluid communication with said outlet port; and the valve mechanism comprises a movable member for selectively controlling the flow of fluid through the starting fuel supply passage, said valve mechanism mounted directly in said carburetor main body portion; means capable of biasing the member into a position to close the passage; a two-position rotatable cam means acting between the carburetor and the movable member, said cam means comprises a first cam surface securable to the carburetor body and a second cam surface engaged with the movable member; such that a first position of the cam means defines a closed condition of the passage and a second position of the cam means defines an open condition of the passage such that when the throttle shutter is in a partially open position and the starting fuel supply passage is open, the fuel pump causes fuel to be injected through the starting fuel supply passage into the carburetor mixing passage.

11. A combination as claimed in claim 10, wherein the movable member is axially slidable during movement of the cam means between its two positions.

12. A combination as claimed in claim 10 wherein one of the cam surfaces is rotatable relative to the other cam surface.

13. A combination as claimed in claim 10 wherein said first cam surface is provided on a bushing securable in the carburetor body and said second cam surface is provided on a control lever engaged with the movable member.

14. A combination as claimed in claim 13 wherein the biasing means is located in a recess in the bushing and acts between a collar on the movable member and a sealing member also located in the recess in the bushing.

* * * * *